US008615967B1

(12) United States Patent
Figovsky et al.

(10) Patent No.: US 8,615,967 B1
(45) Date of Patent: Dec. 31, 2013

(54) CONSTRUCTION ELEMENT FOR ERECTING STRUCTURE, AND METHOD OF ERECTING STRUCTURE WITH USE THEREOF

(75) Inventors: Oleg Figovsky, Haifa (IL); Arkady Futoriynsky, Ashdod (IL)

(73) Assignees: Malaxit, Baku (AZ); Polymate, Ltd., Haifa (IL)

( * ) Notice: Subject to any disclaimer, the term of this patent is extended or adjusted under 35 U.S.C. 154(b) by 0 days.

(21) Appl. No.: 13/539,596

(22) Filed: Jul. 2, 2012

(51) Int. Cl.
*E04B 7/16* (2006.01)

(52) U.S. Cl.
USPC ..... 52/745.2; 52/69; 52/70; 52/79.5; 52/641; 52/646; 52/71

(58) Field of Classification Search
USPC ..... 52/70, 71, 72, 69, 73, 79.5, 641, 646, 52/655.1, 122.1, 125.1, 745.18, 745.2, 52/742.14
See application file for complete search history.

(56) References Cited

U.S. PATENT DOCUMENTS

| | | | | | |
|---|---|---|---|---|---|
| 435,604 | A * | 9/1890 | Hasselman | 52/70 |
| 4,185,430 | A * | 1/1980 | Gartung | 52/285.4 |
| 4,865,213 | A * | 9/1989 | Kruger | 52/280 |
| 4,982,538 | A * | 1/1991 | Horstketter | 52/259 |
| 4,989,379 | A * | 2/1991 | Suzuki | 52/66 |
| 5,152,109 | A * | 10/1992 | Boers | 52/143 |
| 5,381,633 | A * | 1/1995 | Hendrich | 52/71 |
| 5,511,345 | A * | 4/1996 | Jones et al. | 52/136 |
| 5,761,854 | A * | 6/1998 | Johnson et al. | 52/69 |
| 6,178,701 | B1 * | 1/2001 | De Paepe et al. | 52/36.2 |
| 6,253,498 | B1 * | 7/2001 | Fanucci | 52/69 |
| 6,345,471 | B1 * | 2/2002 | Gyllenhammar | 52/69 |
| 6,553,698 | B1 * | 4/2003 | Kemeny | 40/610 |
| 6,681,544 | B2 * | 1/2004 | Wall | 52/745.2 |
| 7,658,037 | B2 * | 2/2010 | Bucher et al. | 52/67 |
| 7,882,659 | B2 * | 2/2011 | Gyory et al. | 52/79.5 |
| 8,056,573 | B2 * | 11/2011 | Panigot | 135/147 |
| 8,156,691 | B2 * | 4/2012 | Dickson et al. | 52/79.5 |
| 8,201,362 | B2 * | 6/2012 | Alford et al. | 52/69 |
| 8,276,499 | B1 * | 10/2012 | Fuqua et al. | 89/36.09 |
| 8,347,560 | B2 * | 1/2013 | Gyory et al. | 52/79.5 |
| 2007/0245637 | A1 * | 10/2007 | Czyznikiewicz | 52/71 |
| 2009/0217600 | A1 * | 9/2009 | De Azambuja | 52/79.5 |
| 2010/0018130 | A1 * | 1/2010 | Lopez et al. | 52/71 |
| 2010/0050540 | A1 * | 3/2010 | Bucher et al. | 52/67 |
| 2010/0089229 | A1 * | 4/2010 | Ackerman et al. | 89/36.04 |

* cited by examiner

*Primary Examiner* — William Gilbert
*Assistant Examiner* — Alp Akbasli
(74) *Attorney, Agent, or Firm* — Henry M. Feiereisen, LLC

(57) ABSTRACT

A construction element for erecting a structure has a first panel extending vertically to form a wall and a second panel extending horizontally to form a horizontal partition when they are arranged in an erected structure, the panels together form a three-dimensional configuration and are connected with one another so that in the erected structure they extend perpendicularly to one another and are turnable to include an angle there between to reduce a horizontal extension of the construction element for transportation purposes.

10 Claims, 6 Drawing Sheets

CONSTRUCTION ELEMENT FOR ERECTING STRUCTURE, AND METHOD OF ERECTING STRUCTURE WITH USE THEREOF

BACKGROUND OF THE INVENTION

The present invention generally relates to construction elements for erecting structures, and also to methods of erecting structures with the use of construction elements. Construction elements for erecting structures are conventionally flat elements, which are assembled at a site of construction for erecting a structure. Such flat constructions elements cannot be too wide because their transportation with the use of conventional transportation means is not possible. It is therefore necessary to use the construction elements with reduced width to allow their transportation, or to produce wide construction elements at the construction site. It is therefore believed that it would be advisable to improve existing construction elements and methods for erection of structures with their use.

SUMMARY OF THE INVENTION

Accordingly, it is an object of the present invention to provide a construction element for erecting structures, as well as method for erection of structures with its use, which eliminate the disadvantages of the prior art.

In keeping with these objects and with others which will become apparent hereinafter, one feature of the present invention resides, briefly stated, in a construction element for erecting a structure, comprising at least one first panel configured to extend substantially vertically when it is arranged in an erected structure to form a wall, and at least one second panel configured to extend substantially horizontally when it is arranged in the erected structure to form a substantially horizontal partition, wherein said first panel and said second panel together have a three-dimensional configuration and are connected with one another so that said first and second panels arranged in the erected structure extend substantially perpendicular to one another and also said first or second panel are turnable relative to one another to include an acute angle there between so as to reduce a horizontal extension of the construction element for transportation purposes.

In accordance with another feature of the present invention, the construction element has hinge means pivotally connecting said first and second panels with one another so that they can turn relative to one another to assume one position in which they are located at the acute angle relative to one another and another position in which they extend substantially perpendicular to one another.

In accordance with the invention, the construction element also has means for immovably fixing said first and second panels with one another in said another position in which they extend substantially perpendicular to one another. Still a further feature of the present invention is that the construction element can have a further such second panel which is located at opposite side of said first panel in regard to said first mentioned second panel and is turnable relative to said first panel to be located at an acute angle relative to said first panel or substantially perpendicular to said first panel, so that said first panel and both said second panels together form said three-dimensional configuration. In accordance with the present invention, also a method of erecting a structure, comprising the steps of providing a plurality of such three-dimensional construction elements; transporting the construction elements to a site for erection of the structure with the first and second panels of the construction elements being arranged at an acute angle relative to one another; at the site for erection of the structure, turning the first or second panels relative to one another so that said first and second panels extend substantially perpendicular to one another; and assembling the structure from the constructions elements in which the first and second panels extend substantially perpendicular to one another.

The novel feature of the present invention are defined in the appended claims, while the construction and the operation of the invention will be best understood from the following description of the preferred embodiments which is accompanied by the following drawings.

DESCRIPTION OF THE PREFERRED EMBODIMENTS

Figure 1:
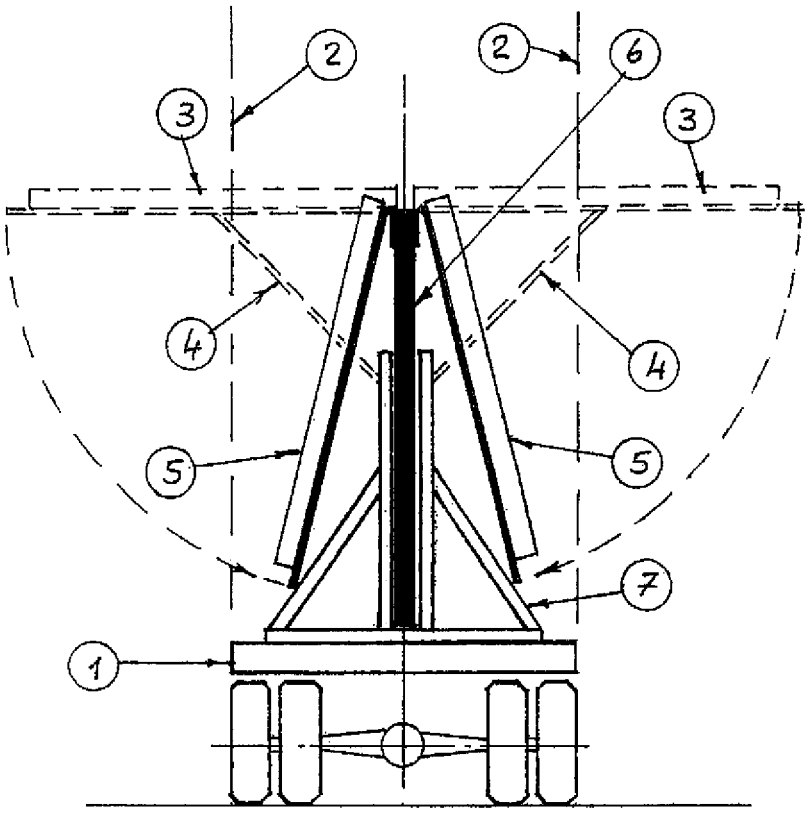
FIG. 1 is a view showing transportation of a construction element in accordance with the present invention, in a folded state.

With reference to the drawings, reference numeral 1 identified a transportation vehicle for transporting construction elements in accordance with the present invention. It has a horizontal width determined between vertical planes 2.

Reference numeral 3 identifies substantially panels of the construction elements which can be formed as composite iron-reinforced concrete panels and in an erected structure extend substantially horizontally to form or to support a floor and/or a ceiling. A mounting element 4 is further provided, and the above mentioned panels in a lowered position are identified with reference numeral 5.

Further panels of the construction elements which can be also formed as composite iron-reinforced concrete panels and in the erected structure form inner substantially vertical wall panels are identified with reference numeral 6. Still further panels of the inventive construction elements which also can be formed as composite iron-reinforced concrete panels are in the erected structure form outer substantially vertical wall panels are identified with reference numeral 8. A support 7 supports the panel.

The erected structure has a foundation 9, flat composite iron-reinforced panels 10, monolithic non-removable iron-reinforced horizontal partition 11, tubular inclined support 12 for temporarily supporting the wall panels during mounting. Reference numerals 13 identifies a temporary, disassembleble steel support for mounting, 14 is a thermal coating, 15 is a monolithic concrete, 17 is a wooden support bar, 17 are anchor bolts and 18 is a steel armature. Reference numerals 18 and 19 identify steel reinforcement, reference numerals 20 and 21 identify fixing structures, and reference numeral 21 identifies a steel reinforcement net.

In accordance with the present invention, the panel 8 with the panel 3 form a three-dimensional construction element of one type, while the panel 6 with one panel 3 at one side or with two panels 3 form a three-dimensional construction element of another type.

The erection of a structure in accordance with the present invention is performed in the following manner.

As shown in FIG. 1, the support 7 is placed on the transporting vehicle 1 and support the three-dimensional inventive structural component. The inner wall panel 6 is fixed in a vertical position, and the outer wall panel 8 can be fixed in by the mounting elements 4, and then turned downwardly for transportation so that they do not extend horizontally outwardly beyond the planes 2.

Figure 2:
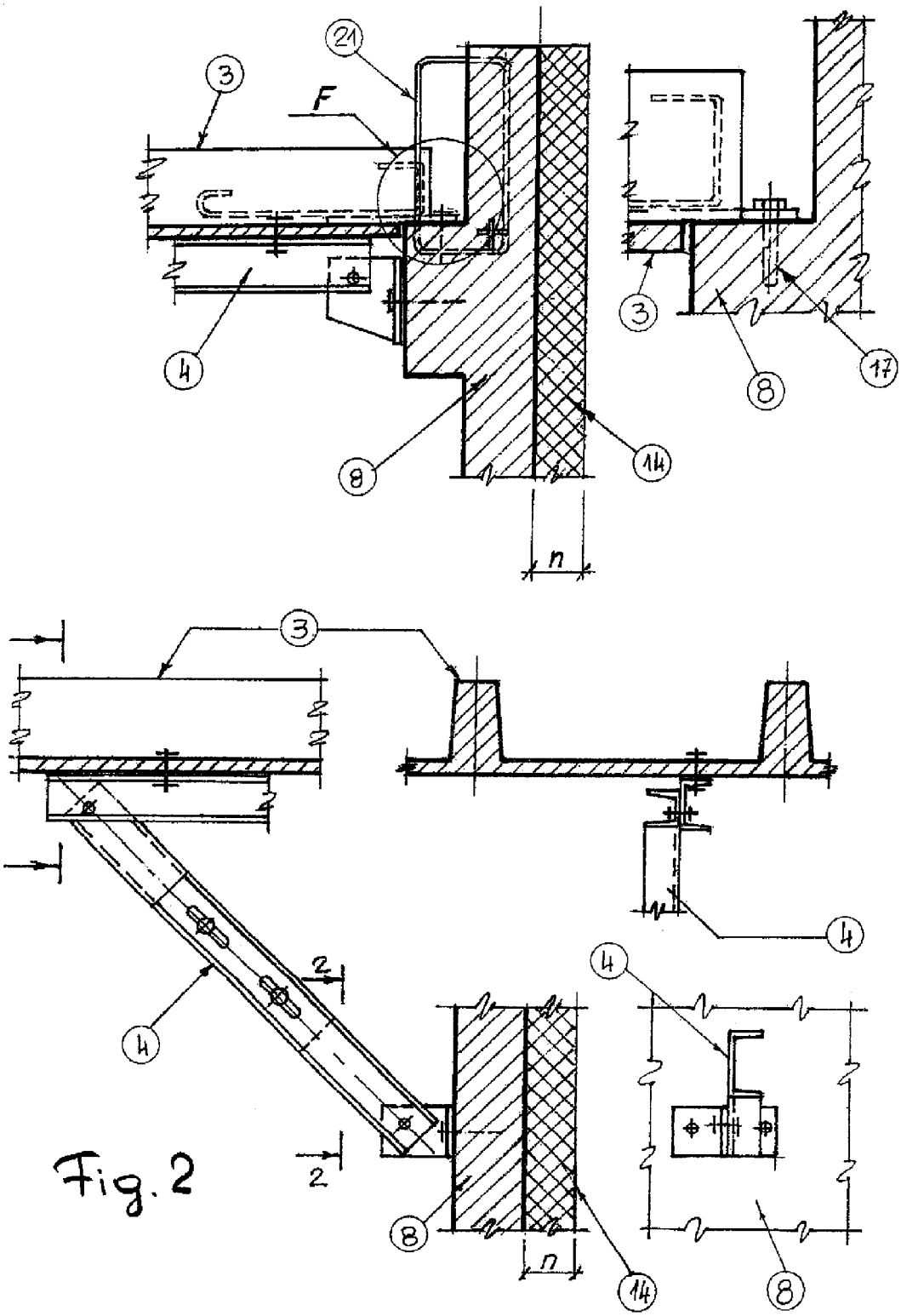
FIGS. 2, 3 and 4 are views illustrating successive stages of assembling components of a structure to be erected from the inventive construction elements.

FIG. 2 shows a construction element composed of the panel 3 and panel 8. The anchor belt 17 is used to fix an extending console rib panel 3 to the panel 8, and the temporary mounting element 4 is fixed to the wall panel 8 and allows turning to change geometry of the three-dimensional structural component. The thermal coating 14 is glued to the outer surface of the panel 8. The step of connecting the mounting element 4 to the wall panel 8 and the panel 3 is illustrated on lower view.

Figure 3:
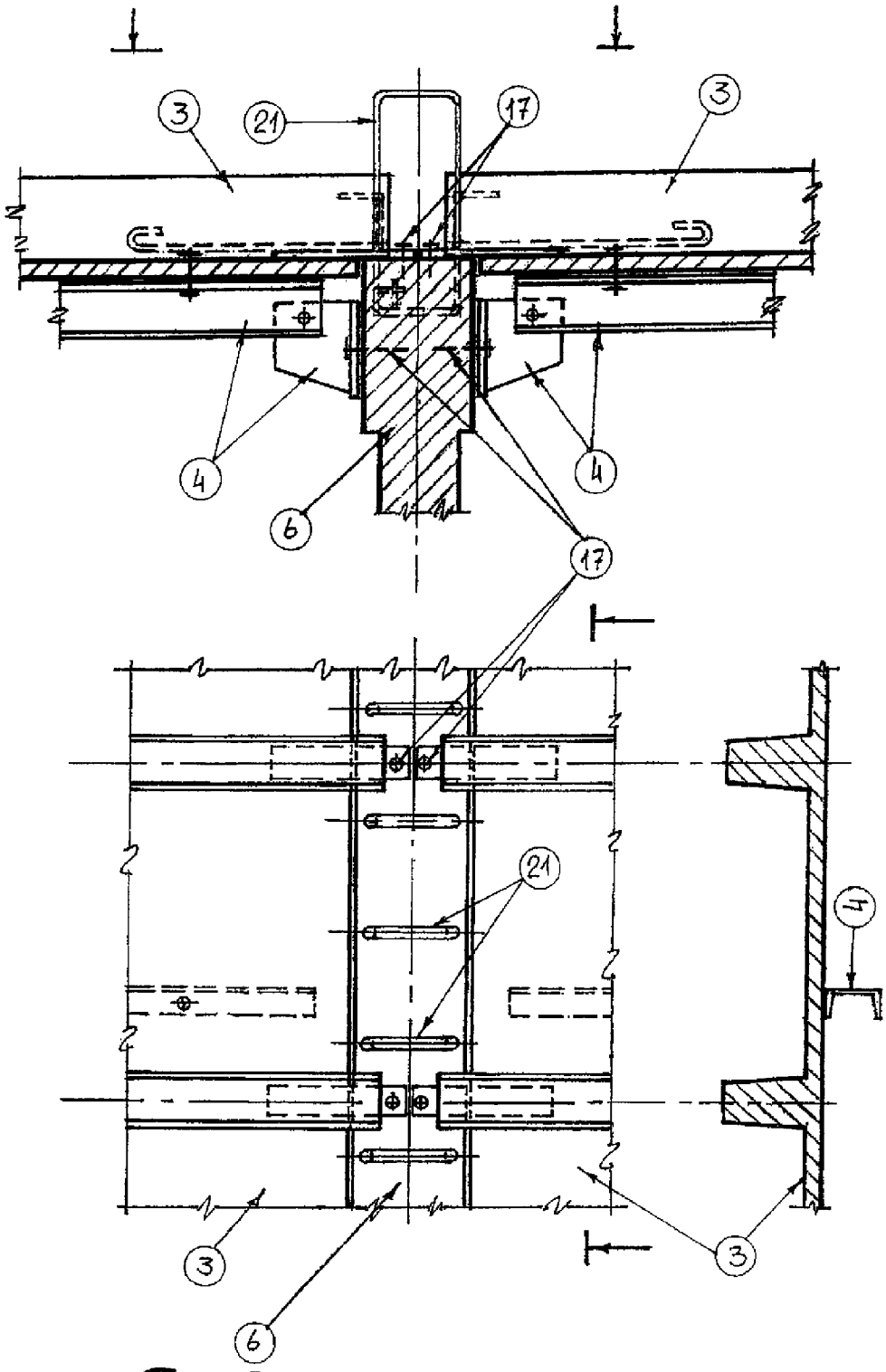

FIG. 3 shows a connection of the panels 3 with the inner panel 6. The console (or console ribs of the panels 3 are connected with the inner panel 6 by the anchor bolts 17. The mounting element 4 are placed and perform the same functions as in FIG. 2.

Figure 4:
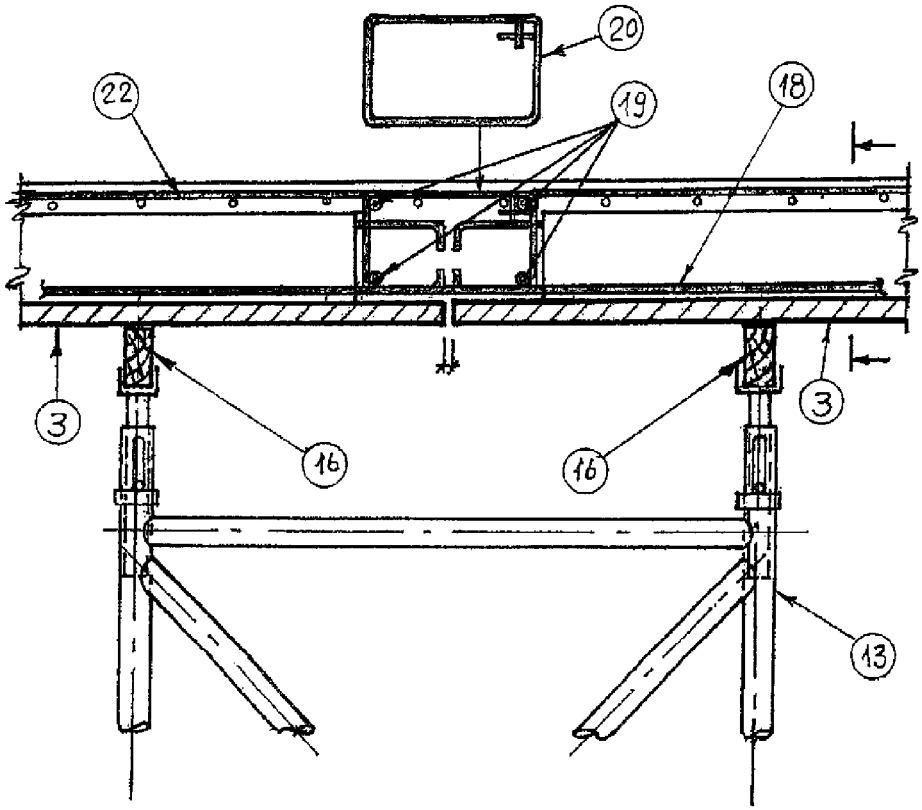
Figure 4:
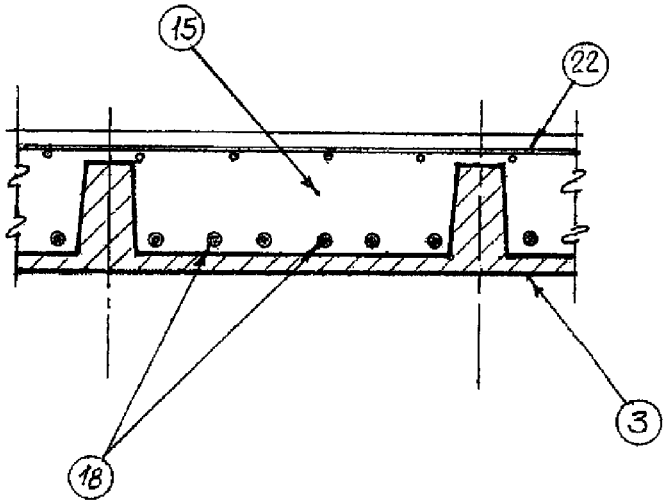

FIG. 4 shows the panel 3 in a middle of the structure, supported on temporary mounting supports 13 with the longitudinal wooden bar 16. It also shows reinforcement of the monolithic horizontal element in the middle of the structure. It shows as an example the working calculated reinforcement 18, the structural designed reinforcement 19, fixing structures 20 composed of steel reinforcement, the steel reinforcement net 22, the monolithic concrete 15.

Figure 5:
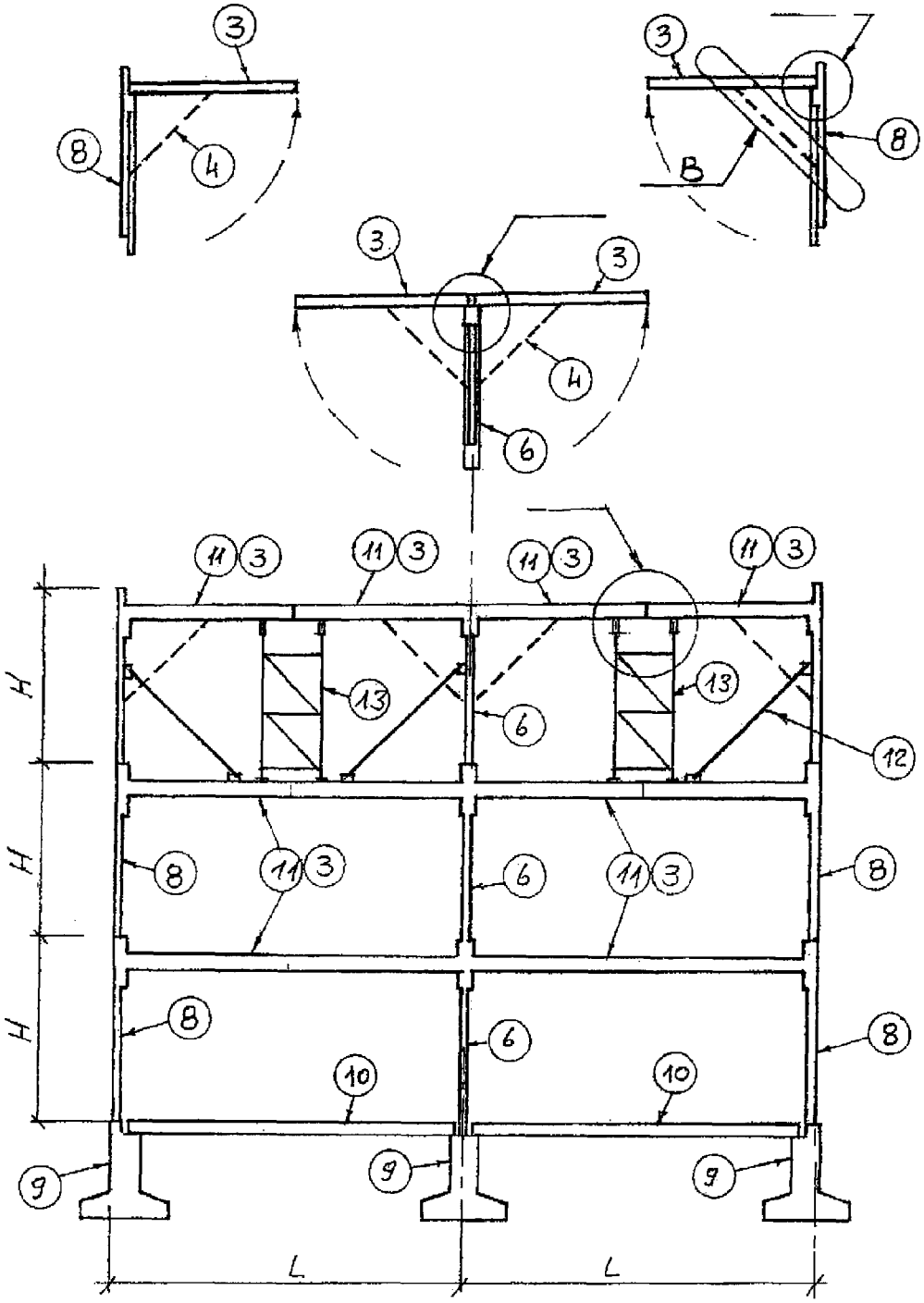
FIG. 5 is a front view of the construction elements and the structure erected with the use of the construction elements.

FIG. 5 shows the process of mounting of the structural components. After the transportation, the construction elements are converted into a working position. The panels 3 are lifted to assume a horizontal position on the transporting vehicle and fixed by the mounting element 4. The mounting of the first level is performed after mounting of the flat panels 10 on the foundation elements 9. The mounting of the three-dimensional construction elements is performed by simultaneous actions on the panels 6, 8 and 3. The wall panels 6 and 8 are placed on the panels of the lower level and the foundation elements 9. Then the wall panels are immovably fixed by the tubular supports 12. The panel 3 in the middle part of the level is supported on the temporary support 13 and abuts against the neighboring panel 3. After pouring of the monolithic concrete over the composite iron-reinforced panels 3, a monolithic iron-reinforced horizontal construction 11 is formed. The process are repeated for the next, upper level, etc.

Figure 6:
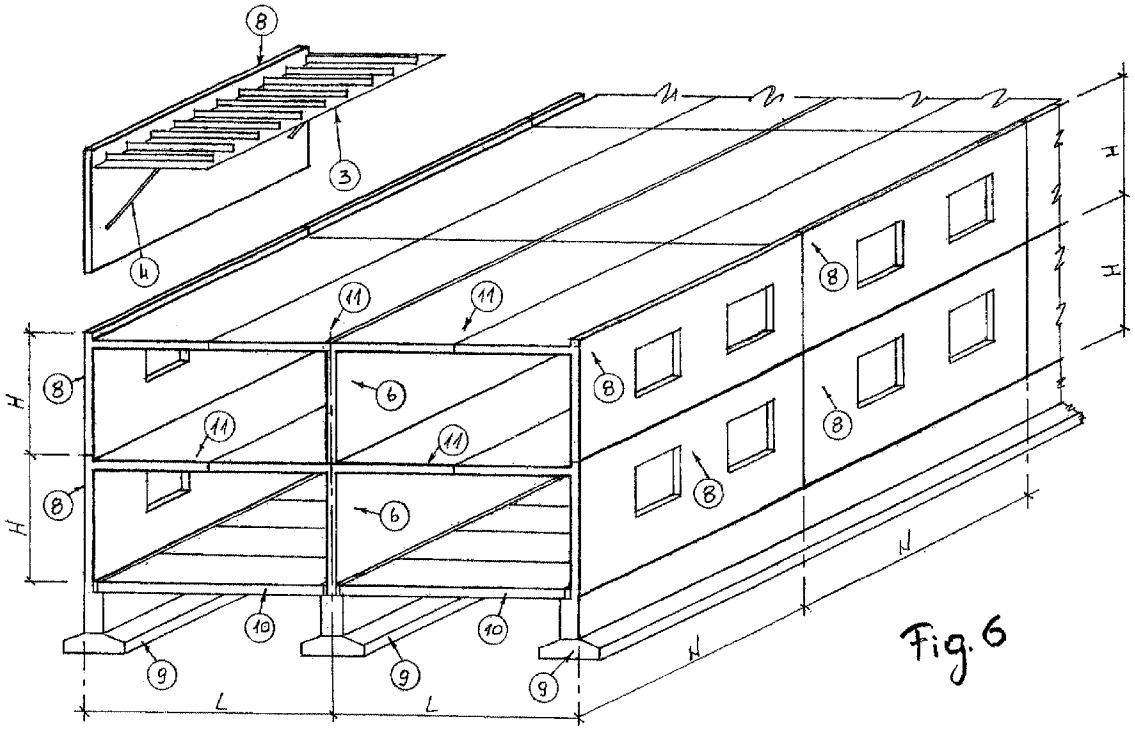
FIG. 6 is perspective view showing the three-dimensional construction element and the three-dimensional structure erected with the use thereof.

FIG. 6 shows a three-dimensional structure erected with the use of the three-dimensional construction element in accordance with the present invention. It can be seen, that the panels 3 can be additionally provided with ribs which are spaced from one another.

The invention is not limited to the details shown since various modifications and structural changes are possible without departing from the spirit of the present invention.

What is desired to be protected by Letters Patent is set forth in particular in the appended claims:

1. A method of erecting a multi-level structure, comprising the steps of providing a plurality of three-dimensional construction elements each including a first wall forming panel for extending vertically and forming a wall of an erected structure and a second floor or ceiling forming ribbed composite iron-reinforced concrete panel for extending substantially horizontally and forming a floor or a ceiling of the erected structure and provided with a plurality of vertically extending ribs spaced from one another in a horizontal direction; transporting the construction elements to a site for erection of the structure, with the first wall forming panel and the second floor or ceiling forming panel of each of the construction elements arranged in a vertical plane at an angle relative to one another; at the site for erection of the structure, turning the second floor or ceiling forming panel relative to the first wall forming panel about a hinged connection so that the second floor or ceiling forming panels extend horizontally while the first wall forming panels extend vertically; on one level placing two of the construction elements so that their first wall forming panels extend vertically and form opposite walls, while their second floor or ceiling forming panels extend toward one another so that they abut against one another and supported in a middle of the one level by a temporary support; pouring a monolithic concrete on the two second ribbed composite iron-reinforced concrete panels extending horizontally and abutting against one another; and repeating the steps of placing two of the construction elements and pouring a monolithic concrete for each of subsequent level of the structure to be erected.

2. A method as defined in claim 1, further comprising arranging tubular inclined supports which temporary support said first wall forming panels after the turning.

3. A method as defined in claim 1, further comprising placing the first wall forming panels of one of the levels on the first wall forming panels of another one of the levels before the pouring of the monolithic concrete.

4. A method as defined in claim 1, further comprising arranging a steel reinforcement on said second floor or ceiling forming panel before the pouring of the monolithic concrete.

5. A method of erecting a multi-level structure, comprising the steps of providing a plurality of first three-dimensional construction elements each including a first wall forming panel for extending vertically and forming a wall of an erected structure and a second floor or ceiling forming ribbed composite iron-reinforced concrete panel for extending substantially horizontally and forming a floor or a ceiling of the erected structure and provided with a plurality of vertically extending ribs spaced from one another in a horizontal direction; providing a plurality of second three-dimensional construction elements each including, in addition to the first and second panels, a further such second ribbed composite iron-reinforced floor or ceiling forming panel located at an opposite side of the first wall forming panel in the regard to the first-mentioned second floor or ceiling forming panel and provided with a plurality of vertically extending ribs spaced from one another in a horizontal direction; transporting the construction elements to a site for erection of the structure, with the first wall forming panel and the second floor or ceiling forming panel of each of the construction elements arranged in a vertical plane at an angle relative to one another; at the site for erection of the structure, turning the second floor or ceiling forming panel relative to the first wall forming panel about a hinged connection so that the second floor or ceiling forming panels extend horizontally while the first wall forming panels extend vertically; placing on each of levels the two first construction elements spaced from one another in a horizontal direction and one of second construction element between the two first mentioned construction elements as considered in a horizontal direction; extending the second ribbed composite iron-reinforced panels from the two first construction elements horizontally toward one another; extending one of the second ribbed composite iron-reinforced panels of the second construction element toward the second ribbed composite iron-reinforced panel of one of the first construction elements in abutment with it; extending the other of the second ribbed composite iron-reinforced panels of the second construction element toward the second ribbed iron-reinforced panel of the other first construction element in abutment with the latter; pouring of monolithic concrete over all four ribbed composite iron-reinforced panels of the two first construction elements and the one second construction element on each level; and repeating the steps of placing the constructions elements and pouring the monolithic concrete for each subsequent level to be erected.

6. A method as defined in claim 5, further comprising arranging tubular inclined supports which temporarily support said first wall forming panels after the turning.

7. &method as defined in claim 5, further comprising placing the first wall forming panels of one of the levels on the first wall forming panels of another one of the levels before the pouring of the monolithic concrete.

8. A method as defined in claim 5, further comprising arranging a steel reinforcement on said second floor or ceiling forming panels before the pouring of the monolithic concrete.

9. Construction elements for erecting a multi-level structure, comprising the a plurality of three-dimensional construction elements each including a first wall forming panel for extending vertically and forming a wall of an erected structure and a second floor or ceiling forming ribbed composite iron-reinforced concrete panel for extending substantially horizontally and forming a floor or a ceiling of the erected structure and provided with a plurality of vertically extending ribs spaced from one another in a horizontal direction, said first wall forming panel and said second floor or ceiling forming panel being constructed so that for transporting of the construction elements to a site for erection of the structure, the first wall forming panel and the second floor or ceiling forming panel of each of the construction elements can be arranged in a vertical plane at an angle relative to one another, while at the site for erection of the structure, the second floor or ceiling forming panel about a hinged connection can be turned relative to the first wall forming panel so that the second floor or ceiling forming panels extend horizontally while the first wall forming panels extend vertically and on one level two of the construction elements can be placed so that their first wall forming panels extend vertically and form opposite walls, while their first floor or ceiling forming panels extend toward one another so that they abut against one another and supported in a middle of the one level by a temporary support, and a monolithic concrete can be poured on the two second ribbed composite iron-reinforced concrete panels extending horizontally and abutting against one another, and on each again two of the construction elements can be placed and a monolithic concrete can be poured on each of subsequent level of the structure to be erected.

10. Constructions elements for erecting a multi-level structure, a plurality of first three-dimensional construction elements each including a first wall forming panel for extending vertically and forming a wall of an erected structure and a second floor or ceiling forming ribbed composite iron-reinforced concrete panel for extending substantially horizontally and forming a floor or a ceiling of the erected structure and provided with a plurality of vertically extending ribs spaced from one another in a horizontal direction; and a plurality of second three-dimensional construction elements each including, in addition to the first and second panels, a further such second ribbed composite iron-reinforced floor or ceiling forming panel located at an opposite side of the first wall forming panel in the regard to the first-mentioned second floor or ceiling forming panel and provided with a plurality of vertically extending ribs spaced from one another in a horizontal direction, with the panels configured so that for transporting the construction elements to a site for erection of the structure, the first wall forming panel and the second floor or ceiling forming panel of each of the construction elements can be arranged in a vertical plane at an angle relative to one another, while at the site for erection of the structure, the second floor or ceiling forming panel can be turned relative to the first wall forming panel about a hinged connection so that the second floor or ceiling forming panels extend horizontally while the first wall forming panels extend vertically, on each of levels the two first construction elements can be placed so that they are spaced from one another in a horizontal direction and one of second construction element can be placed between the two first mentioned construction elements as considered in a horizontal direction, the second ribbed composite iron-reinforced panels can extend from the two first construction elements horizontally toward one another; one of the second ribbed composite iron-reinforced panels of the second construction element can extend toward the second ribbed composite iron-reinforced panel of one of the first construction elements in abutment with it, the other of the second ribbed composite iron-reinforced panels of the second construction element can extend toward the second ribbed iron-reinforced panel of the other first construction element in abutment with the latter, a monolithic concrete can be poured over all four ribbed composite iron-reinforced panels of the two first construction elements and the one second construction element on each level, and the constructions elements can be placed and the monolithic concrete can be poured for each subsequent level to be erected.

* * * * *